US009359913B2

(12) United States Patent
Montgomery et al.

(10) Patent No.: US 9,359,913 B2
(45) Date of Patent: Jun. 7, 2016

(54) STEAM TURBINE INNER SHELL ASSEMBLY WITH COMMON GROOVES

(71) Applicant: General Electric Company, Schnectady, NY (US)

(72) Inventors: Michael Earl Montgomery, Niskayuna, NY (US); Fred Thomas Willett, Burnt Hills, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 642 days.

(21) Appl. No.: 13/778,404

(22) Filed: Feb. 27, 2013

(65) Prior Publication Data

US 2014/0241869 A1 Aug. 28, 2014

(51) Int. Cl.

| | |
|---|---|
| ***F01D 9/04*** | (2006.01) |
| ***F01D 25/24*** | (2006.01) |
| ***F01D 25/26*** | (2006.01) |

(52) U.S. Cl.

CPC *F01D 25/24* (2013.01); *F01D 9/04* (2013.01); *F01D 9/042* (2013.01); *F01D 25/246* (2013.01); *Y10T 29/49229* (2015.01)

(58) Field of Classification Search

CPC ..... F01D 9/042

See application file for complete search history.

(56) References Cited

U.S. PATENT DOCUMENTS

| | | | | |
|---|---|---|---|---|
| 798,106 | A | | 8/1905 | Kerr |
| 1,112,295 | A | | 9/1914 | Kieser |
| 1,923,251 | A | | 8/1933 | Bauer et al. |
| 3,572,968 | A | | 3/1971 | Musick et al. |
| 3,881,842 | A | | 5/1975 | Kosyak et al. |
| 3,881,843 | A | | 5/1975 | Meylan |
| 3,915,588 | A | | 10/1975 | Brandstatter |
| 4,509,238 | A | | 4/1985 | Lee et al. |
| 4,585,478 | A | | 4/1986 | Yoshioka et al. |
| 4,602,412 | A | | 7/1986 | Partington et al. |
| 4,666,369 | A | | 5/1987 | Brinkman |
| 4,710,102 | A | | 12/1987 | Ortolano |
| 4,764,658 | A | | 8/1988 | Panzeri |
| 4,765,046 | A | | 8/1988 | Partington et al. |
| 4,936,002 | A | | 6/1990 | Silvestri, Jr. et al. |
| 5,060,842 | A | | 10/1991 | Qureshi et al. |
| 5,211,540 | A | | 5/1993 | Evans |
| 5,236,349 | A | | 8/1993 | Fabris |
| 5,238,368 | A | | 8/1993 | Ortolano |
| 5,326,221 | A | | 7/1994 | Amyot et al. |
| 5,350,276 | A | * | 9/1994 | Gros ..... F01D 25/24 415/168.4 |
| 5,509,784 | A | | 4/1996 | Caruso et al. |
| 5,511,941 | A | | 4/1996 | Brandon |
| 5,791,147 | A | | 8/1998 | Earley et al. |
| 5,794,446 | A | | 8/1998 | Earley et al. |
| 5,798,082 | A | | 8/1998 | Kadoya et al. |
| 5,961,280 | A | | 10/1999 | Turnquist et al. |
| 5,961,284 | A | | 10/1999 | Kuriyama et al. |
| 5,997,806 | A | | 12/1999 | Fujita et al. |

(Continued)

*Primary Examiner* — Mary A Davis

(74) *Attorney, Agent, or Firm* — Nixon & Vanderhye P.C.

(57) ABSTRACT

An inner shell assembly for a steam turbine includes an inner shell with a plurality of grooves of preset dimensions, and a plurality of nozzle carriers respectively securable in the plurality of grooves. Each of the nozzle carriers supports at least one nozzle and bucket for a turbine stage via a dovetail, where the inner shell, the plurality of nozzle carriers and the nozzles and buckets define a steam path. A radial position of the dovetails in the nozzle carriers within its corresponding grooves is selectable according to the steam path, and an axial width of each of the nozzle carriers is selectable according to the steam path.

24 Claims, 9 Drawing Sheets

(56) References Cited

U.S. PATENT DOCUMENTS

| | | | |
|---|---|---|---|
| 6,036,437 | A | 3/2000 | Wolfe et al. |
| 6,109,869 | A | 8/2000 | Maddaus et al. |
| 6,171,053 | B1 | 1/2001 | Ulma |
| 6,233,939 | B1 | 5/2001 | Ngo-Beelmann et al. |
| 6,273,675 | B1 | 8/2001 | Magoshi et al. |
| 6,416,277 | B1 | 7/2002 | Manges, Jr. |
| 6,629,819 | B1 | 10/2003 | Brown et al. |
| 6,631,858 | B1 | 10/2003 | Farineau et al. |
| 6,742,988 | B2 | 6/2004 | Mundra et al. |
| 6,827,554 | B2 | 12/2004 | Caruso et al. |
| 6,843,479 | B2 | 1/2005 | Burdgick |
| 6,846,160 | B2 | 1/2005 | Saito et al. |
| 6,877,952 | B2 | 4/2005 | Wilson |
| 6,939,106 | B2 | 9/2005 | Murphy et al. |
| 6,971,844 | B2 | 12/2005 | Burdgick |
| 7,097,423 | B2 | 8/2006 | Burdgick |
| 7,097,428 | B2 | 8/2006 | Barb et al. |
| 7,207,773 | B2 | 4/2007 | O'Clair et al. |
| 7,270,518 | B2 | 9/2007 | Barb et al. |
| 7,329,098 | B2 | 2/2008 | Burdgick |
| 7,427,187 | B2 | 9/2008 | Burdgick et al. |
| 7,458,770 | B2 | 12/2008 | Russo et al. |
| 7,713,023 | B2 | 5/2010 | Hamlin et al. |
| 7,713,024 | B2 * | 5/2010 | Burdgick ..... F01D 9/041 415/209.3 |
| 7,722,314 | B2 * | 5/2010 | Burdgick ..... F01D 25/246 415/209.2 |
| 7,887,291 | B2 | 2/2011 | Chevrette et al. |
| 7,900,431 | B2 | 3/2011 | Willson et al. |
| 7,981,360 | B2 | 7/2011 | Singh et al. |
| 8,056,608 | B2 | 11/2011 | Goodwin et al. |
| 8,128,353 | B2 | 3/2012 | Flanagan et al. |
| 8,197,197 | B2 | 6/2012 | Flanagan |
| 8,834,114 | B2 * | 9/2014 | Sterantino ..... F01D 25/246 415/209.2 |
| 2011/0008173 | A1 | 1/2011 | Tsukuda et al. |

* cited by examiner

STEAM TURBINE INNER SHELL ASSEMBLY WITH COMMON GROOVES

BACKGROUND OF THE INVENTION

The invention relates generally to steam turbines and, more particularly, to an inner shell assembly for a steam turbine including common grooves to facilitate inner shell manufacture.

A steam turbine is a mechanical device that extracts energy from pressurized steam and converts the energy into useful work. Steam turbines receive a steam flow at an inlet pressure through multiple stationary nozzles that direct the steam flow against buckets rotationally attached to a rotor of the turbine. The steam flow impinging on the buckets creates a torque that causes the rotor of the turbine to rotate, thereby creating a useful source of power for turning an electrical generator or other mechanical device. The steam turbine includes, along the length of the rotor, multiple pairs of nozzles (or fixed blades) and buckets. Each pair of nozzle and bucket is called a stage. Each stage extracts a certain amount of energy from the steam flow causing the steam pressure and temperature to drop and the specific volume of the steam flow to expand. Consequently, the size of the nozzles and the buckets (stages) and their distance from the rotor grow progressively larger in the later stages.

Steam turbine customers require unique steam turbine designs that are optimized for the customer's plant and yield economically appropriate delivery, cost, performance, reliability, availability, and maintainability. Historically, this customer need has been met by supplying steam turbine steam paths that are unique to the customer's plant. In the past, the inner shells, carriers, and other components were designed specifically for each steam path. This approach led to longer design and procurement cycles for large components such as the shells and inner casings, the proliferation of shell and inner casing designs, and the inability to inventory common or spare components to support customer demand.

FIG. 1 shows prior art inner shell grooving design for wheel and diaphragm type construction. A single shell section with nine stages is shown. The nozzle carrier (diaphragm) for each stage is supported in an individual groove custom machined on the inner surface of the shell. The diameter of the shell groove is established based on the tip diameter of the stage's bucket. The use of this shell for steam paths with larger tip diameters or more stages is extremely limited with this design. This design provides centerline support and alignment provisions for each nozzle of each stage.

FIG. 2 shows prior art for a shell/carrier grooving design for carrier type construction. FIG. 2 shows a section with one shell, two carriers, and 27 reaction stages. There are two nozzle carriers that support the nozzles of their respective stages. Each nozzle is supported in an individual groove machined on the inner surface of their respective carrier. The diameter of the carrier groove is established based on the tip diameter of the stage's bucket. The use of carriers for steam paths with larger tip diameters or more stages is extremely limited with this design. Stage alignment with this design is limited to carrier alignment capability (individual stage alignment is not possible). For this design, average alignment for stages 1-16 and stages 17-27 is feasible.

It would be desirable to provide a modular, flexible, common steam turbine shell/inner casing design that will accommodate a wide range of steam paths. Such structure would serve to reduce the need to provide multiple designs for steam turbine shell/inner casings designs and provide for a dramatic decrease in the time needed to design and procure steam turbine shells/inner casings. Additionally, such structure would facilitate the ability to carry shell and inner casing inventory to further expedite the turbine delivery cycle.

BRIEF DESCRIPTION OF THE INVENTION

In an exemplary embodiment, an inner shell assembly for a steam turbine includes an inner shell with a plurality of grooves of preset dimensions, and a plurality of nozzle carriers respectively securable in the plurality of grooves. Each of the nozzle carriers supports at least one nozzle and bucket for a turbine stage via a dovetail, where the inner shell, the plurality of nozzle carriers and the nozzles and buckets define a steam path. A radial position of the dovetails in the nozzle carriers within its corresponding grooves is selectable according to the steam path, and an axial width of each of the nozzle carriers is selectable according to the steam path.

In another exemplary embodiment, a steam turbine includes an outer shell and an inner shell assembly defining a steam flow path, and a rotor and a stator disposed in the steam flow path. A plurality of stationary nozzles is coupled with the stator that direct steam in the steam flow path into a plurality of rotatable buckets coupled with the rotor. The inner shell assembly includes an inner shell including a plurality of grooves of preset dimensions, and a plurality of nozzle carriers respectively securable in the plurality of grooves. Each of the nozzle carriers supports at least one nozzle for a turbine stage. A radial position of the nozzles within the nozzle carriers in the corresponding grooves is selectable according to the steam path, and an axial width of each of the nozzle carriers is selectable according to the steam path.

In still another exemplary embodiment, a method of forming a steam path with an inner shell assembly in a steam turbine includes the steps of forming a plurality of grooves of preset dimensions in an inner shell; respectively securing a plurality of nozzle carriers in the plurality of grooves, each of the nozzle carriers supporting at least one nozzle for a turbine stage. The securing step is practiced by (1) selecting an axial width of each of the nozzle carriers according to the steam path, and (2) selecting a radial position of the at least one nozzle in the nozzle carriers in the corresponding grooves according to the steam path.

DETAILED DESCRIPTION OF THE INVENTION

Figure 1:
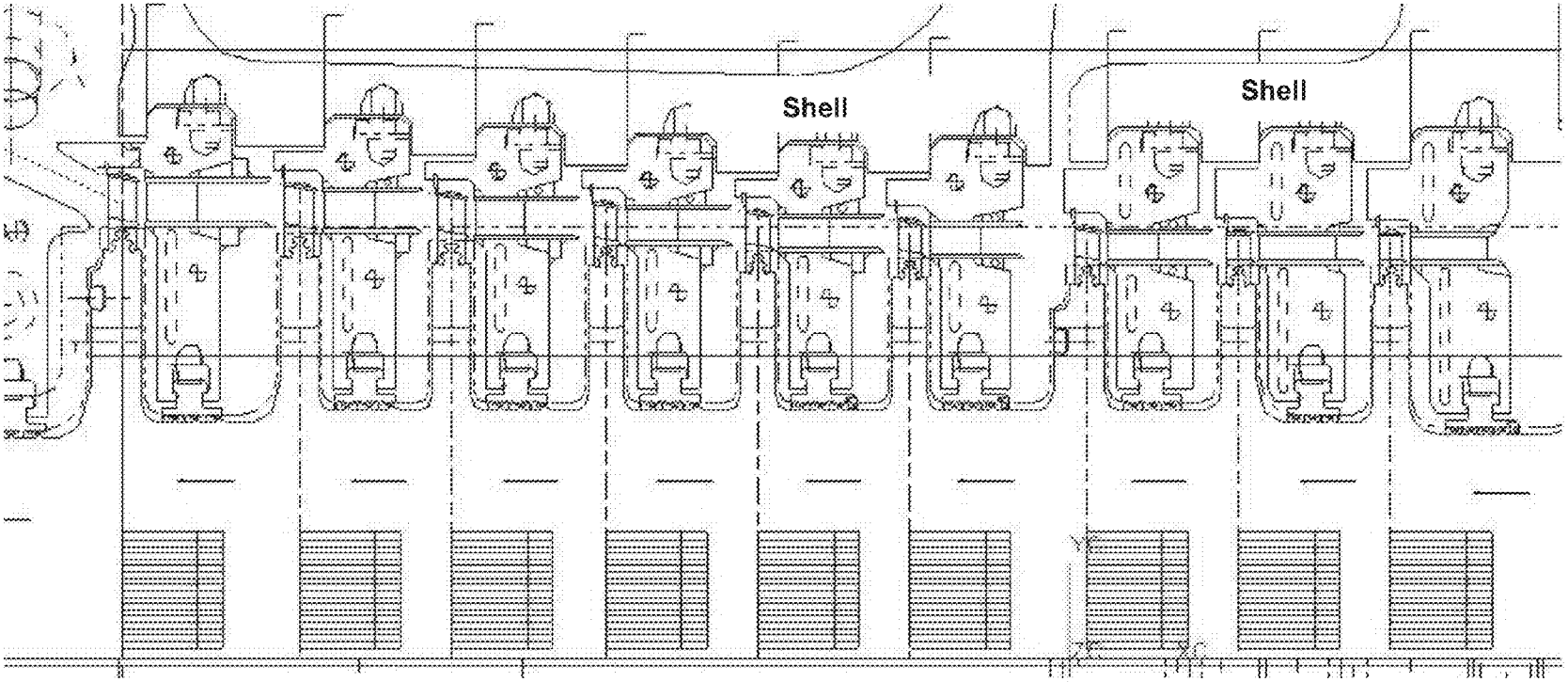
FIG. 1 (PRIOR ART)
FIG. 1 is a prior art shell grooving design for wheel and diaphragm type construction.
Figure 2:
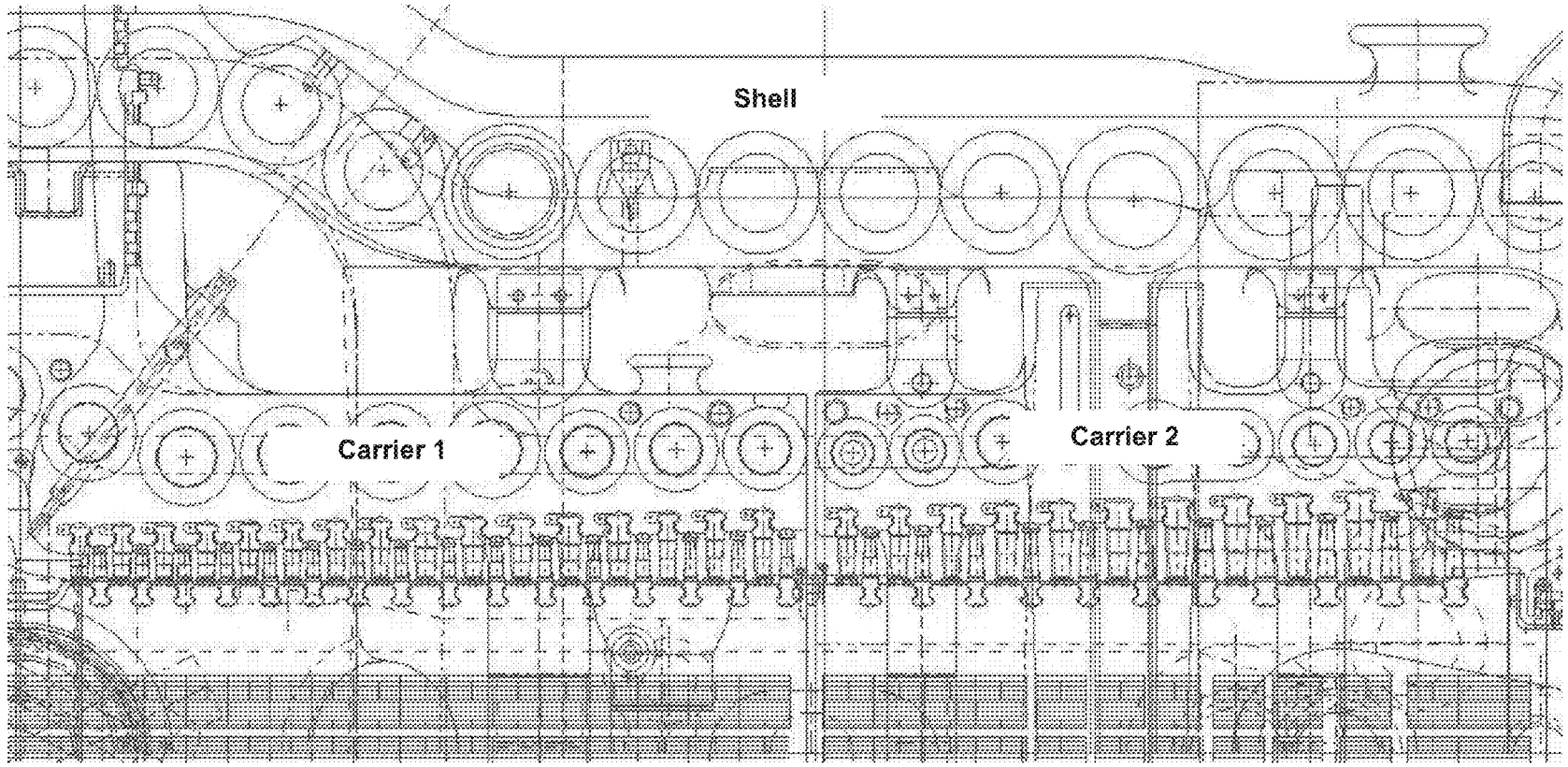
FIG. 2 (PRIOR ART)
FIG. 2 is a prior art shell/carrier grooving design for carrier type construction.
Figure 3:
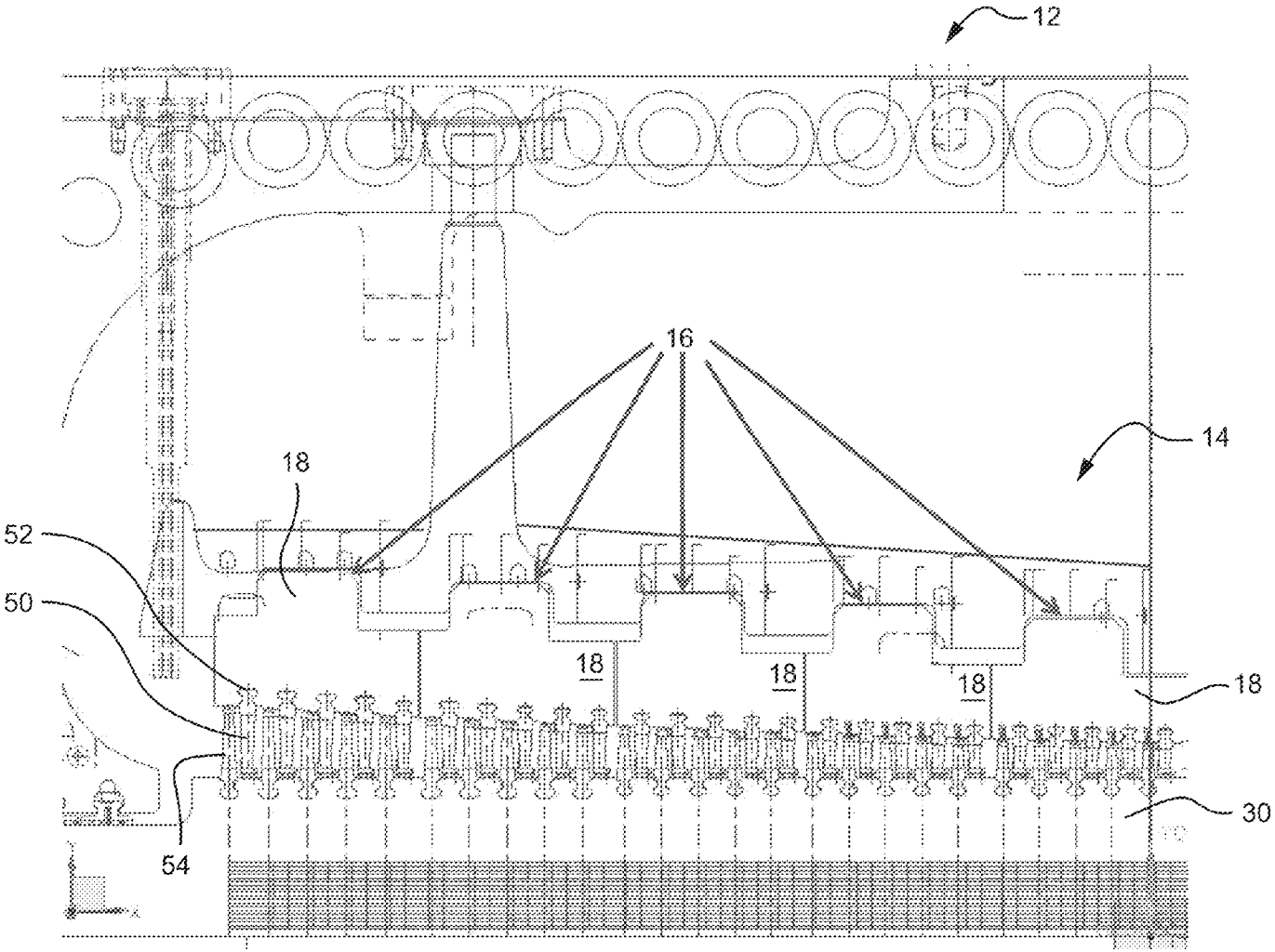
FIG. 3 shows a steam turbine including an inner shell assembly with common grooves.

FIG. 3 shows an exemplary application in a steam turbine with an inner shell assembly including common grooves. The steam turbine includes an outer shell 12 and an inner shell 14. The outer and inner shells 12, 14 generally define a space available for a steam path across various turbine stages. As shown, the inner shell 14 is provided with a plurality of grooves 16 of preset dimensions.

There are five grooves 16 shown in FIG. 3. The grooves 16 are used to support nozzle carriers 18. That is, the nozzle carriers 18 are respectively securable in the plurality of grooves 16. Each of the nozzle carriers 18 supports at least one nozzle 50 for a turbine stage. The nozzle 50 has an integral dovetail 52 that is used to secure the nozzle 50 to the nozzle carrier 18. A bucket 54 is also shown for the stage. The assembly may include hybrid designs where some nozzles are welded and others are attached with dovetails. The total axial and radial space available to accommodate the steam path is fixed by the outer shell 12, inner shell 14 and the fixed common grooves 16. The nozzle carriers 18 are selectively positionable in the grooves and are selectively sized to accommodate a desired steam path. That is, a radial position of the nozzle 50 and the nozzle dovetails 52 in the nozzle carrier 18 and corresponding grooves 16 is selectable according to the steam path, and an axial width of each of the nozzle carriers 18 in the corresponding grooves 16 is selectable according to the steam path. The width of the carriers 18 determines number of nozzles supported by the carrier. Regardless of the carrier size, however, each of the carriers is configured to be secured in the grooves 16.

The groove design can be standard for all the grooves in the shell/inner casing 14. That is, the preset dimensions of the grooves 16 can be determined prior to defining the customer-specific steam path. In one embodiment, the axial widths of each of the plurality of grooves are equivalent, and the radial depths of each of the plurality of grooves are equivalent. In this manner, tooling and hardware requirements for constructing the inner shell 14 are simplified. The grooves 16 use the same vertical transverse and torsional support and alignment provisions and nozzle carrier to shell/inner casing interface.

In designing the assembly, the steam turbine design space to be served is determined. Plural steam paths are designed to cover the design space (shortest largest tip diameter and longest smallest tip diameter). The steam turbine section is designed to accommodate these two bounding steam paths including rotor dynamics, thrust clearances, steam path mechanical seals, etc. The grooves are then designed in their radial and axial extent. Once completed, the customer-specific steam path can be uniquely defined within the design space.

Figure 4:
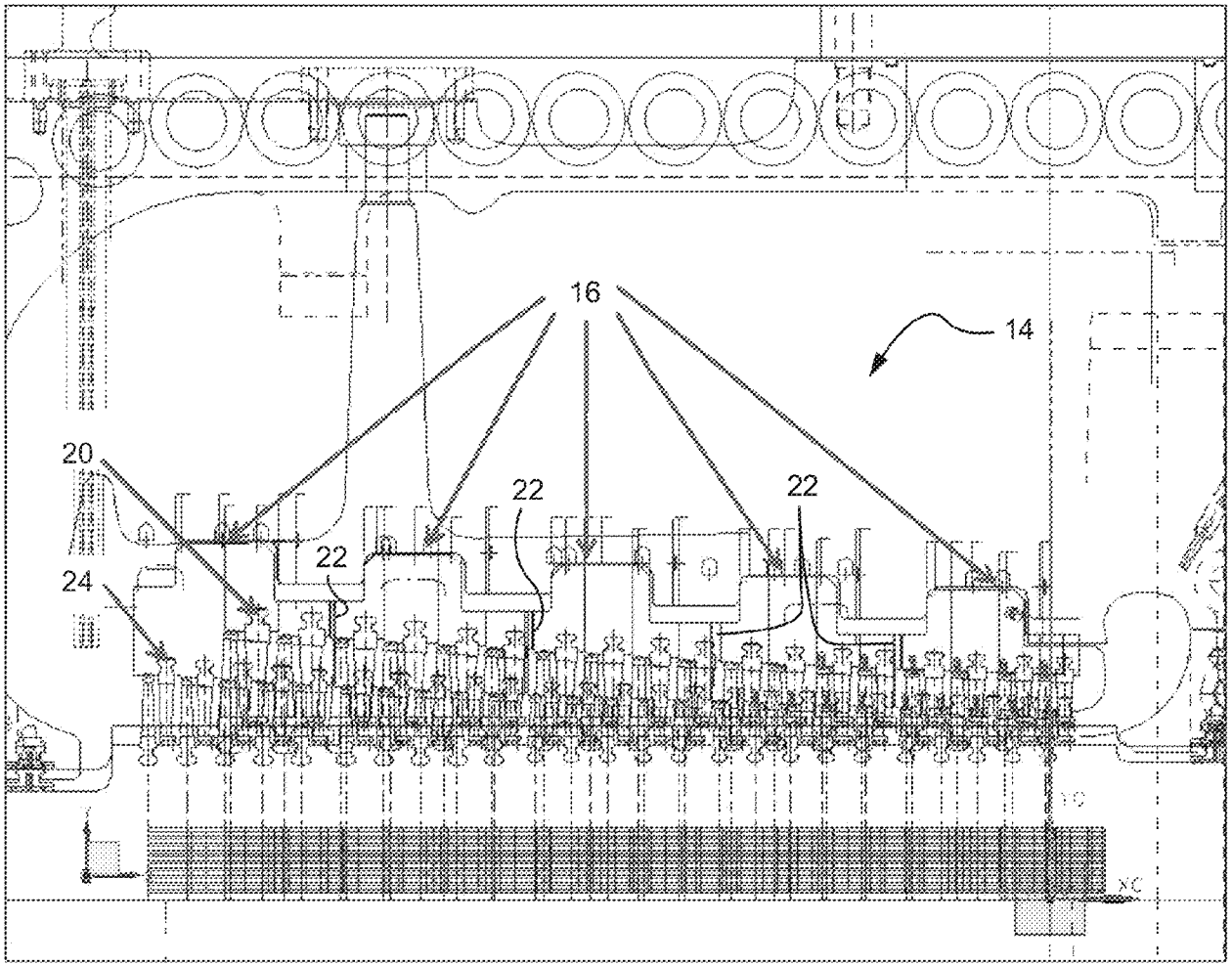
FIG. 4 shows two different steam paths superimposed on each other within the common grooving.

FIG. 4 shows two different steam paths superimposed on each other within the common grooving. A first steam path 20 is in a more conical configuration with fewer stages per carrier 18. By "conical," it will be appreciated that the cylindrical root expansion takes place in fewer stages so the tip expands faster. Split lines 22 between the nozzle carriers 18 are selected to accommodate the desired number of nozzles/stages according to the desired steam path. The second steam path 24 is assembled in more of a cylindrical configuration and includes a higher density of nozzles/stages for each carrier 18. Thus, the plurality of nozzle carriers 18 are positionable in the plurality of grooves 16 such that the nozzles 50 and dovetails 52 can be arranged in configurations from substantially cylindrical (e.g., steam path 24) to conical (e.g., steam path 20) across a radial range of the nozzle carriers 18.

The nozzle carriers 18 may be equally sized in some arrangements or alternatively may be sized differently to accommodate the desired steam path. The nozzle carriers 18 are used to match the different steam paths to the common grooving of the inner shell.

Figure 5:
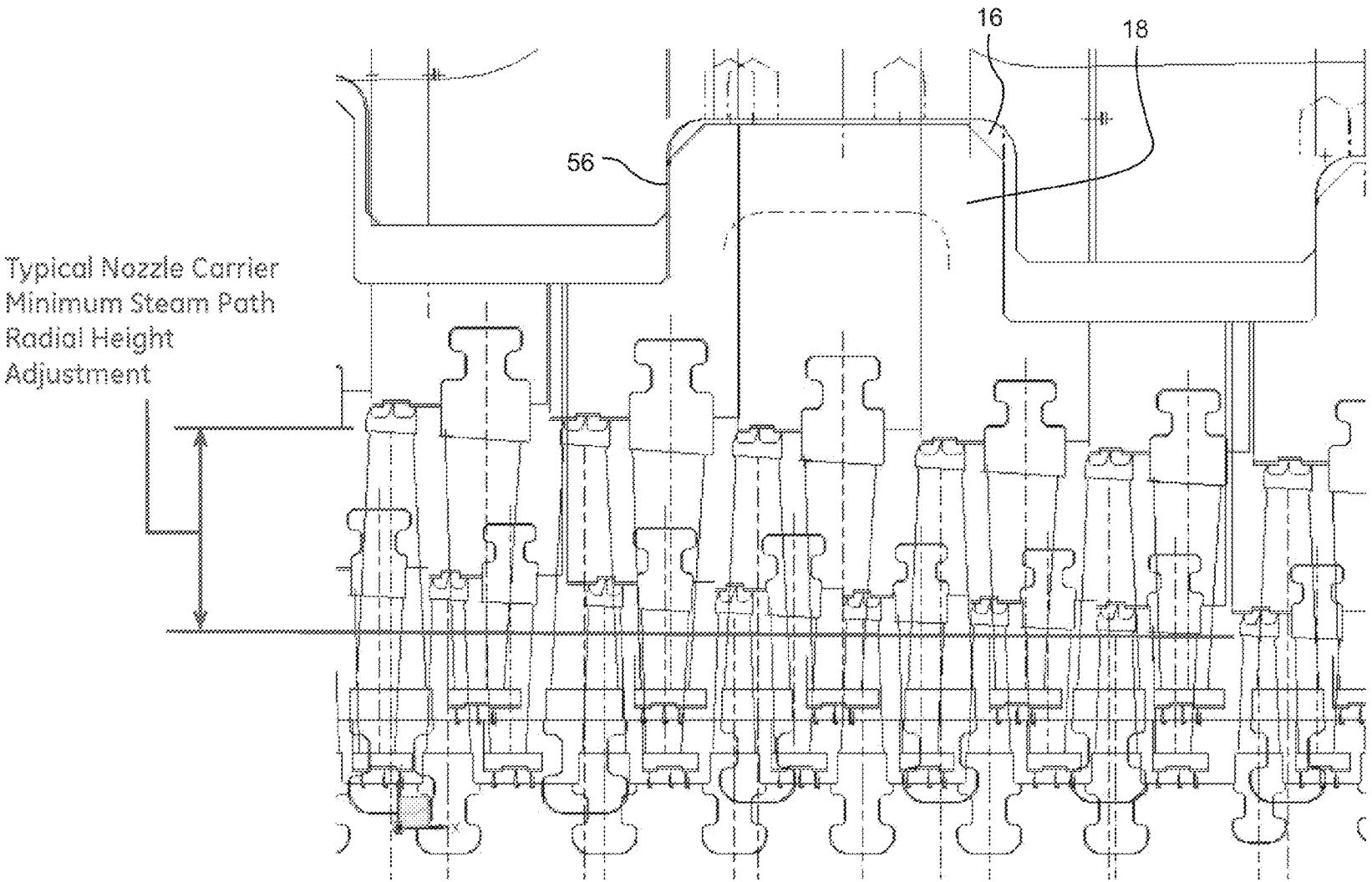
FIG. 5 shows a typical nozzle carrier and the radial range that it is capable of providing to accommodate steam path designs.
Figure 6:
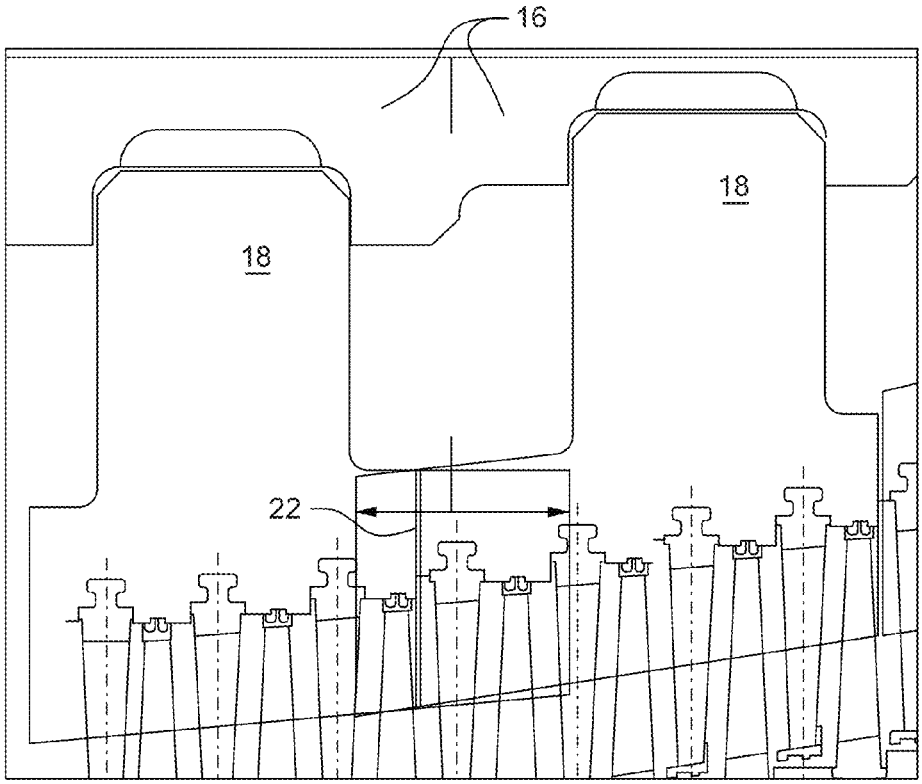
FIG. 6 shows a nozzle carrier and the axial range that it is capable of providing to accommodate steam path designs.

FIG. 5 shows a nozzle carrier 18 and the radial range that it is capable of providing for the nozzles 50 and dovetails 52 to accommodate steam path designs. That is, the nozzles 50 and dovetails 52 can be selectively radially positioned within the common grooves 16 across the range shown in FIG. 5. FIG. 6 shows two nozzle carriers 18 and an axial range for positioning the split line 22 to accommodate various steam path designs. Nozzle carriers 18 can be expected to support 1-10 or more stages. The groove 16 extends circumferentially around the inner surface of the inner shell 14. The nozzle carrier 18 interface is designed like a tongue and groove fit to groove 16. The inner shell 14 and nozzle carrier 18 are typically split at the horizontal joint and may or may not be bolted. A steam joint 56 provides axial support for the nozzle carrier. Other devices are employed to provide vertical and transverse support and for resisting nozzle carrier torsion. Finally, devices are employed to provide alignment of the nozzle carrier 18, nozzles 50 and dovetails 52 to the buckets 54 and rotor 30.

The location of the nozzle split 22 is determined when the final customer steam path is laid out. In general, a split location as far upstream as possible is preferable so pressure closes the horizontal joint. Other factors that may influence its location are stage spacing, rotor weld locations, or sealing requirements.

Figure 7:
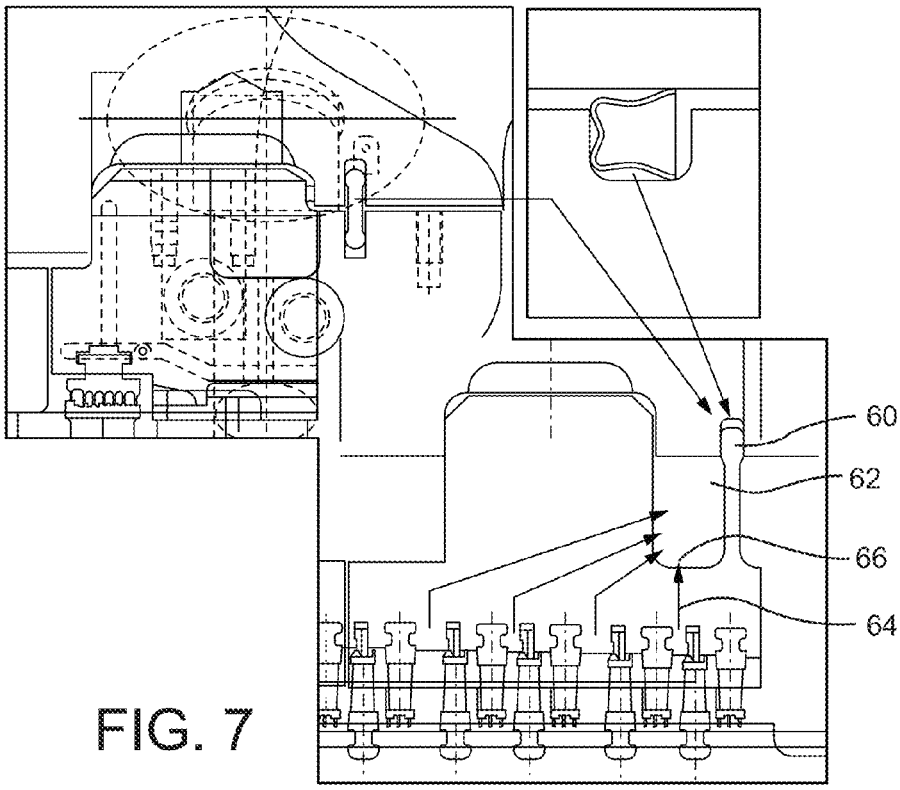
FIG. 7 illustrates a method to refine the source/sink of the extraction/admission down to a single stage using the common grooving method.

The axial locations of the nozzle carrier splits 22 can also be adjusted to accommodate steam extraction or admission pressures. FIG. 7 shows a method to refine the source/sink of the extraction/admission down to a single stage using the common grooving method. A barrier can be used to create an extraction or admission pocket 62 between the nozzle carrier 18 and inner shell 14. A series of pathways (holes) 64 can be used to access any of the stage's downstream conditions. In this manner, an extraction/admission pathway 64 from the stage to the bucket is created. Traditional extraction/admission devices may be used to connect the pocket to other cycle locations.

Figure 8:
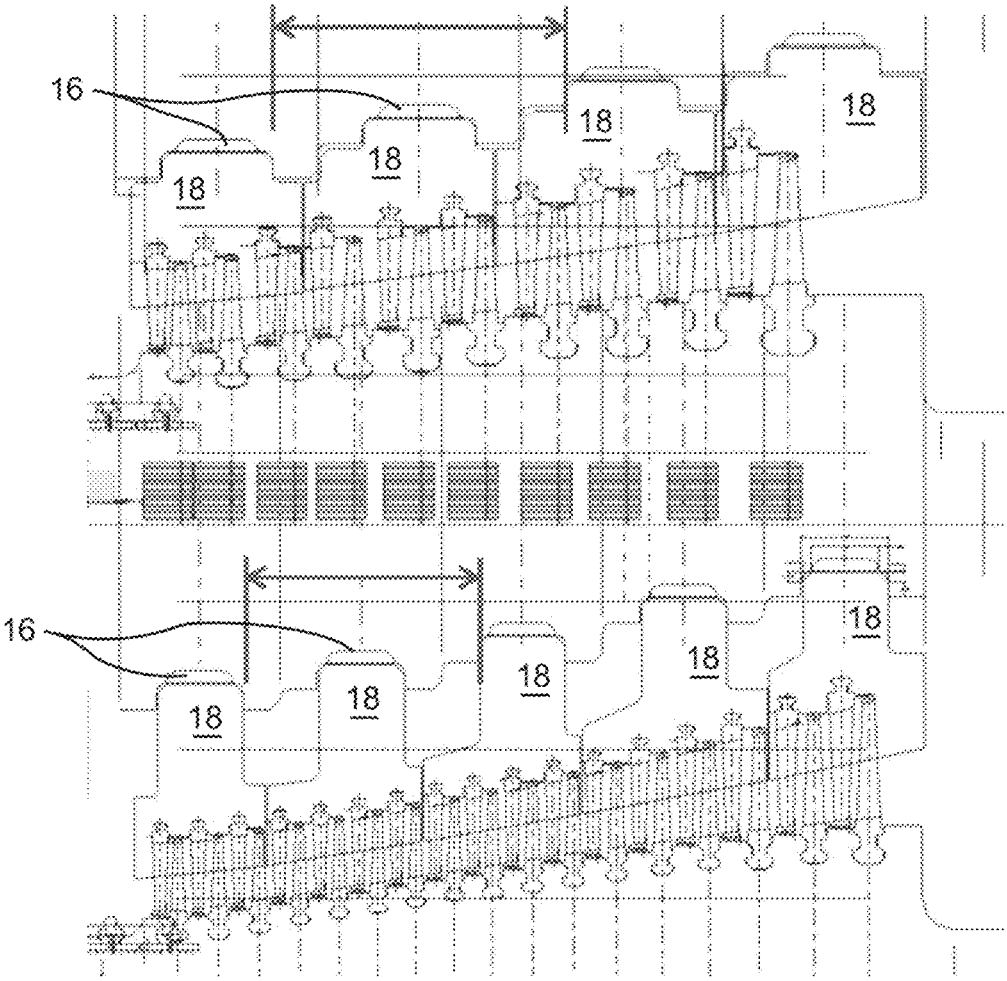
FIG. 8 shows an example of the impact of the number of grooves and groove width on steam path axial design flexibility.

With reference to FIG. 8, it will be appreciated that the steam path axial design flexibility is inversely proportional to the product of the number of grooves and the groove width. If one groove is used, the nozzle carrier becomes similar to another inner shell carrier. If two grooves are used, the nozzle carrier arrangement becomes similar to the split inner shells or two carrier design. Neither of these designs will achieve advantages of the preferred embodiments. Similarly, if the number of grooves approaches the number of stages, the nozzle carrier arrangement becomes similar to a single shell or carrier design that requires custom manufacture to achieve desired steam paths. There is thus an optimum number of grooves and groove widths that maximize axial flexibility of the common grooving to accommodate a wide variety of steam paths.

FIG. 8 shows an example of the impact of the number of grooves and groove width on steam path axial design flexibility. One arrangement shows four common grooves 16 and four nozzle carriers 18. The second example shows five common grooves 16 and five nozzle carriers 18. The four groove design contains fewer stages and greater positioning flexibility, while the five groove design includes more stages while still maintaining positionable flexibility. The axial spacing of the common grooves 16 is adjustable. For a given number of grooves and equal groove widths, maximum adjustability is obtained with equal spacing. Unequal spacing or unequal groove widths, however, can be used if necessary to address unique design requirements.

The axial distribution of shell/inner casing inside surface pressure and temperature can be adjusted by locating the nozzle carrier splits 22 at different axial locations. This adjustment capability facilitates the ability to design shell/inner casing wall and flange thickness, bolting and design to prevent horizontal joint leakage.

One anticipated issue with this concept is the relative change in size between rotor and stator components as design firing level increases. As design volume flow increases, the steam path annulus also increases, resulting in a larger diameter rotor and nozzle carriers with larger inner diameters. The larger inner diameter of the nozzle carriers results in thinner rings as design flow increases.

The differences in carrier size and rotor size mean that thermal response may be different throughout the design space. The thick carriers will be slower to respond to steam temperature changes than the thin carriers. Likewise, the small diameter rotor will respond more rapidly to steam temperature changes than the large diameter rotor. Since clearances are set to avoid or minimize rubs during transient operation, this affects the clearances. Some means of matching the transient response of rotor and stator, or at least minimizing the variation across the design space, may be desirable.

Little can be done to change the thermal response of the rotor, as rotor life, structural integrity, and dynamic response are important requirements that constrain the rotor design space and dictate rotor design. Attention, then, turns to the stator components, primarily the nozzle carrier. Active cooling or heating of the nozzle carrier is possible, and could be used to control the carrier growth during transient operation. This, however, would necessitate the creation of flow circuits for heating/cooling. In addition, this approach would either result in performance loss due to the use of steam for clearance control or the additions of valves, piping, and control system logic to limit active control use to transient operation.

Another approach is to tune the design of the nozzle carriers to achieve the desired thermal response. This can be done in two ways: 1) reduce the mass of the small inside diameter nozzle carriers, and 2) increase the heat transfer to the nozzle carriers.

Figure 9:
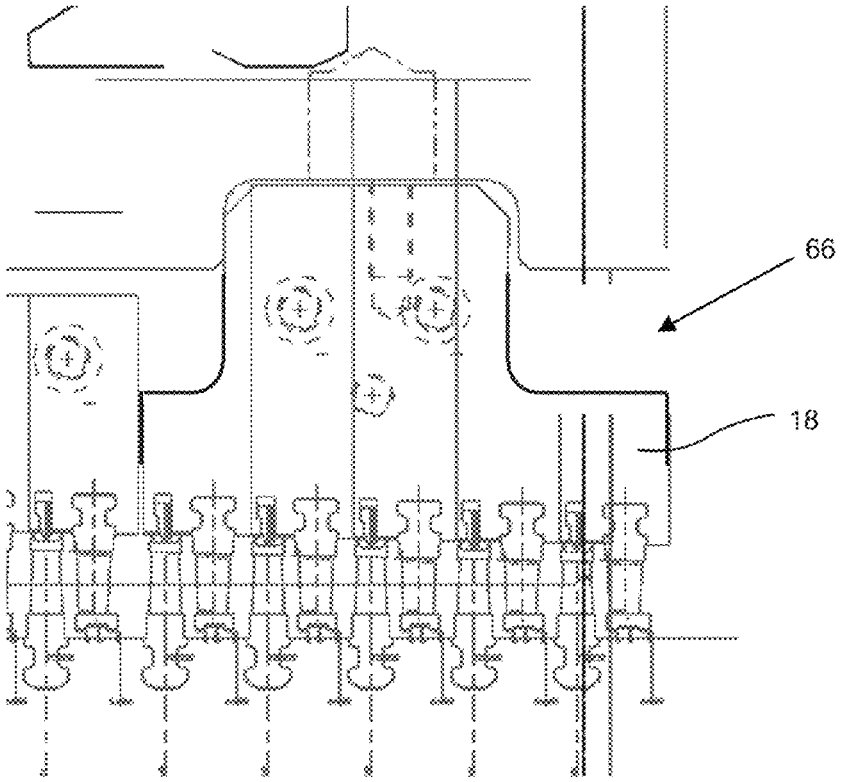
FIG. 9 shows a means for tuning a thermal response by removing mass from the nozzle carrier appendages.
Figure 10:
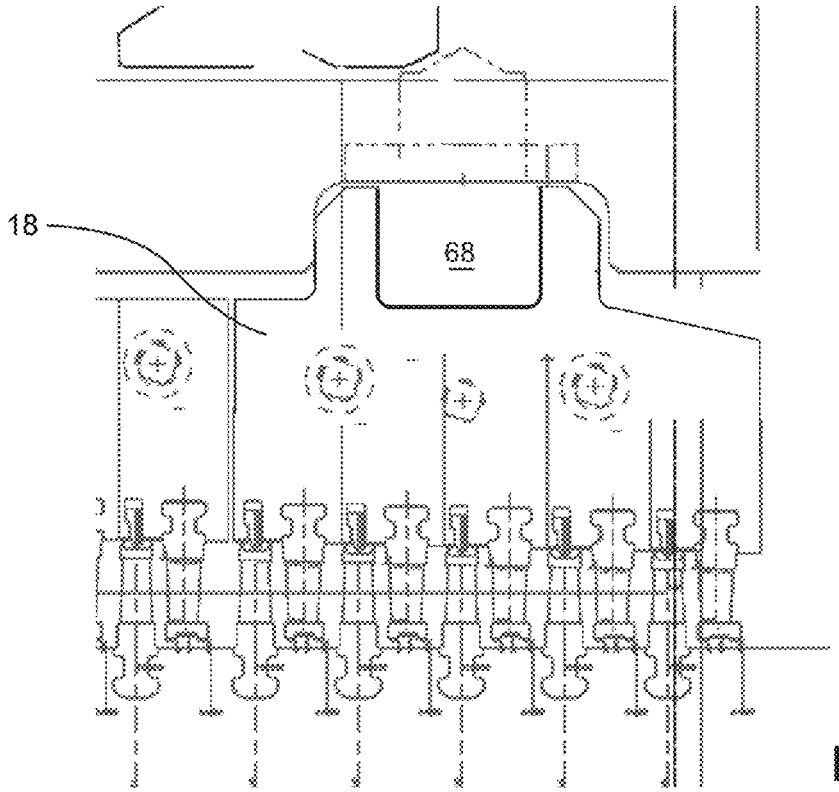
FIG. 10 shows mass removed from an outer portion of the nozzle carrier.

With reference to FIGS. 9 and 10, two approaches are shown. In FIG. 9, mass is removed from appendages 66 of the nozzle carrier 18. This approach may be used, but has two drawbacks: 1) thin appendages are prone to distortion at assembly, and 2) the forward appendage of the first nozzle carrier and the aft appendage of the last nozzle carrier would be used to form steam guides and could not be modified.

In FIG. 10, mass is removed from the outer portion 68 of the nozzle carrier 18. One drawback to this approach is that it limits the space available for horizontal joint bolting and support bars. This problem can be eliminated by making the groove at the outside diameter less than fully circumferential, but at the cost of a more complicated machining operation.

Figure 11:
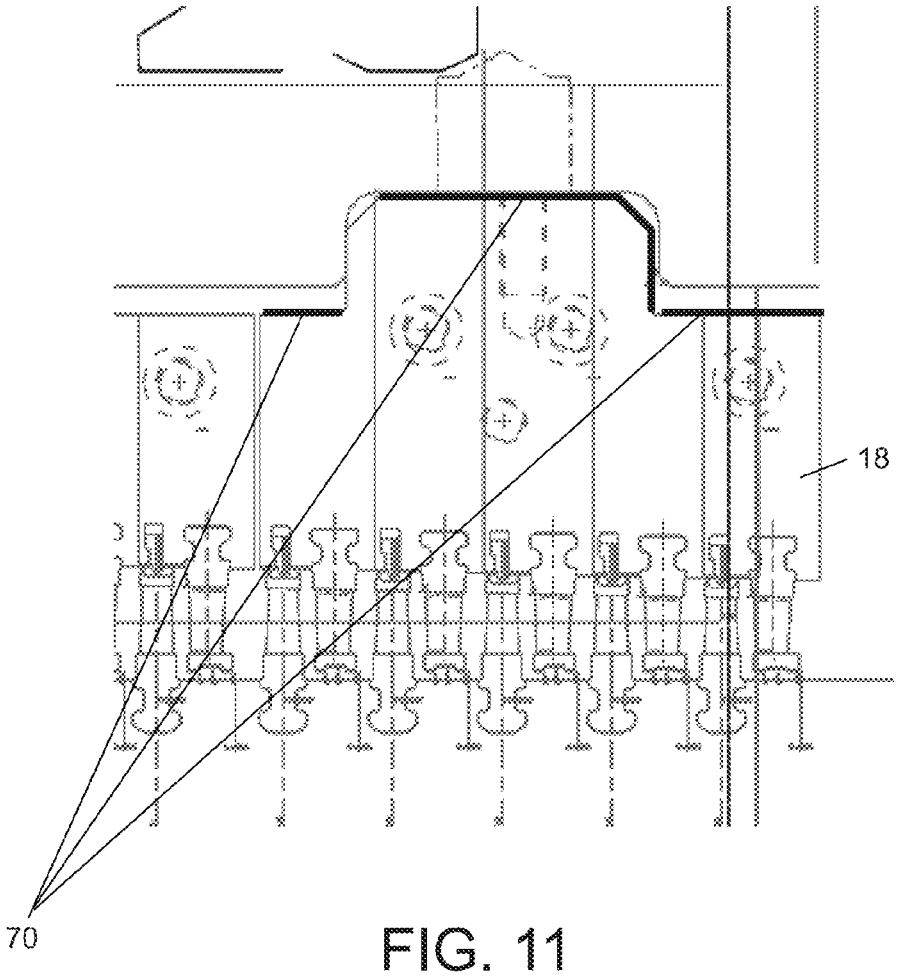
FIG. 11 shows an application of heat transfer enhancement features on the surfaces.
Figure 12:
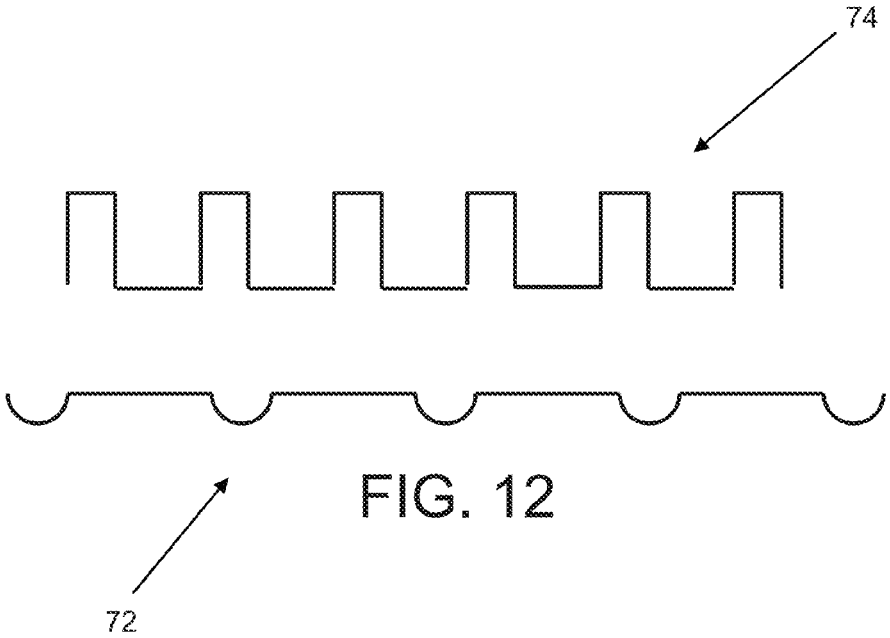
FIG. 12 shows exemplary surfaces for heat transfer enhancement.

Another approach is to apply heat transfer enhancement features 70 on the surfaces shown in FIG. 11, or on the new surfaces created by the groove shown in FIG. 12. Any number of geometries cold be used, including a dimpled surface 72 or a finned surface 74, both shown in profile in FIG. 12.

The inner shell with common grooving and nozzle carriers to cover large steam turbine design spaces facilitates inner shell manufacturing requirements while providing the ability to use the shells, inner casings and nozzle carriers to accommodate a wide range of steam paths. The common grooving reduces the need for multiple steam turbine shell and inner casing designs, provides for a dramatic decrease in the time needed to design and procure steam turbine shells and inner casings, and affords the ability to carry shell and inner casings in inventory to further expedite turbine delivery cycles. The design also provides flexible extraction and admission design capability from/to the steam path for feed water heating, cooling or other cycle connections.

Tuning the nozzle carriers may be effective to achieve a consistent or more nearly consistent transient thermal response of the turbine, regardless of design flow level or design duct firing level. This results in more consistent radial clearances for all turbines in the design space. Cycle time can be reduced by having common long lead material across a wide design space, while at the same time having a design that is robust to the variation in operational response inherent in a design based on the use of common long lead material.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An inner shell assembly of a steam turbine located radially inward of an outer shell of the steam turbine, the inner shell assembly comprising:

an inner shell including a plurality of grooves of preset dimensions; and a plurality of nozzle carriers respectively securable in the plurality of grooves, each of the nozzle carriers supporting at least one nozzle for a steam turbine stage via a dovetail, wherein the inner shell, the plurality of nozzle carriers and the nozzles define a steam path, and wherein a total axial and radial space available to accommodate the steam path is fixed by at least the inner shell and the plurality of grooves, wherein a radial position of the dovetails in the plurality of nozzle carriers within its corresponding plurality of grooves is variable within the total axial and radial space according to the steam path, and wherein an axial width of each of the plurality of nozzle carriers is selectable according to the steam path such that in one assembly with a first steam path in said inner shell, a first number of the nozzles is supported by the plurality of nozzle carriers, and in another assembly with a second steam path in said inner shell, a second number of the nozzles is supported by the plurality of nozzle carriers.

2. An inner shell assembly according to claim 1, wherein the preset dimensions are determined prior to defining the steam path.

3. An inner shell assembly according to claim 1, wherein axial widths of each the plurality of grooves are equivalent, and wherein radial depths of each of the plurality of grooves are equivalent.

4. An inner shell assembly according to claim 1, wherein the plurality of nozzle carriers and nozzles are positionable in the plurality of grooves and nozzle carriers, respectively, such that the plurality of nozzles can be arranged in configurations from substantially cylindrical to conical across a radial range of the plurality of nozzle carriers.

5. An inner shell assembly according to claim 1, wherein respective ones of the plurality of nozzle carriers are equally sized.

6. An inner shell assembly according to claim 1, wherein the plurality of nozzle carriers are sized differently to accommodate the steam path.

7. An inner shell assembly according to claim 1, wherein a steam path axial design flexibility is inversely proportional to a product of the number of grooves and an axial width of the grooves.

8. An inner shell assembly according to claim 1, further comprising at least one steam admission port or steam extraction port through the inner shell and through adjacent ones of the plurality of nozzle carriers.

9. An inner shell assembly according to claim 1, wherein the nozzle carriers are structurally configured to achieve a desired thermal response.

10. An inner shell assembly according to claim 9, wherein the structural configuration of the nozzle carriers to achieve the desired thermal response comprises areas of reduced mass.

11. An inner shell assembly according to claim 10, wherein the areas of reduced mass comprise at least one of appendages of the nozzle carriers and an outer portion of the nozzle carriers.

12. An inner shell assembly according to claim 9, wherein the structural configuration of the nozzle carriers to achieve the desired thermal response comprises nozzle carrier surfaces with increased heat transfer characteristics.

13. An inner shell assembly according to claim 12, wherein the nozzle carrier surfaces with increased heat transfer characteristics comprise at least one of a textured or dimpled surface and a finned surface.

14. A steam turbine comprising:

an outer shell and an inner shell assembly defining a steam flow path;

a rotor and a stator disposed in the steam flow path; and a plurality of stationary nozzles coupled with the stator that direct steam in the steam flow path into a plurality of rotatable buckets coupled with the rotor, wherein the inner shell assembly includes:

an inner shell including a plurality of grooves of preset dimensions, and a plurality of nozzle carriers respectively securable in the plurality of grooves, each of the plurality of nozzle carriers supporting at least one nozzle for a turbine stage, wherein a total axial and radial space available to accommodate the steam flow path is fixed by the outer shell, the inner shell and the plurality of grooves, wherein a radial position of the nozzles within the plurality of nozzle carriers in the corresponding plurality of grooves is variable within the total axial and radial space according to the steam path, and wherein an axial width of each of the plurality of nozzle carriers is selectable according to the steam path such that in one assembly with a first steam path in said inner shell, a first number of the nozzles is supported by the plurality of nozzle carriers and in another assembly with a second steam path in said inner shell, a second number of the nozzles is supported by the plurality of nozzle carriers.

15. A steam turbine according to claim 14, wherein the preset dimensions are determined prior to defining the steam path.

16. A steam turbine according to claim 14, wherein axial widths of each the plurality of grooves are equivalent, and wherein radial depths of each of the plurality of grooves are equivalent.

17. A method of forming a steam path with an inner shell assembly in a steam turbine, the method comprising:

forming a plurality of grooves of preset dimensions in an inner shell;

respectively securing a plurality of nozzle carriers in the plurality of grooves, each of the plurality of nozzle carriers supporting at least one nozzle for a turbine stage, wherein the securing step is practiced by (1) selecting an axial width of each of the plurality of nozzle carriers according to the steam path, and (2) selecting a radial position of the at least one nozzle in the plurality of nozzle carriers in the corresponding plurality of grooves according to the steam path such that in one assembly with a first steam path in said inner shell, a first number of nozzles is supported by the plurality of nozzle carriers and in another assembly with a second steam path in said inner shell, a second number of the nozzles is supported by the plurality of nozzle carriers.

18. A method according to claim 17, wherein the forming step is practiced by determining the preset dimensions prior to defining the steam path.

19. A method according to claim 17, further comprising providing at least one steam admission port or steam extraction port through the inner shell and through adjacent ones of the plurality of nozzle carriers.

20. A method according to claim 17, further comprising tuning the nozzle carriers to achieve a desired thermal response.

21. A method according to claim 20, wherein the tuning step comprises reducing a mass of the nozzle carriers.

22. A method according to claim 21, wherein the reducing step comprises removing material from at least one of appendages of the nozzle carriers and an outer portion of the nozzle carriers.

23. A method according to claim 20, wherein the tuning step comprises providing surfaces of the nozzle carriers with increased heat transfer characteristics.

24. A method according to claim 23, wherein the providing step comprises providing at least one of a textured or dimpled surface and a finned surface.

* * * * *

UNITED STATES PATENT AND TRADEMARK OFFICE

CERTIFICATE OF CORRECTION

PATENT NO. : 9,359,913 B2
APPLICATION NO. : 13/778404
DATED : June 7, 2016
INVENTOR(S) : Montgomery et al.

It is certified that error appears in the above-identified patent and that said Letters Patent is hereby corrected as shown below:

IN THE SPECIFICATION

At column 4, line 41, insert --60-- after "A barrier"

Signed and Sealed this
Ninth Day of August, 2016

Michelle K. Lee

Michelle K. Lee
*Director of the United States Patent and Trademark Office*